US009873245B2

(12) United States Patent
Humet et al.

(10) Patent No.: US 9,873,245 B2
(45) **Date of Patent: *Jan. 23, 2018**

(54) OPERATION OF PRINTING SYSTEMS

(71) Applicant: Hewlett-Packard Development Company, L.P., Houston, TX (US)

(72) Inventors: Jacint Humet, Santa Perpetua de Mogoda (ES); Eduardo Amela, Granyena de Segarra (ES); Jaime Fernandez, San Diego, CA (US); Marc Serra Vall, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/268,041

(22) Filed: Sep. 16, 2016

(65) Prior Publication Data

US 2017/0008276 A1 Jan. 12, 2017

Related U.S. Application Data

(63) Continuation of application No. 14/646,270, filed as application No. PCT/EP2012/073959 on Nov. 29, 2012, now Pat. No. 9,469,125.

(51) Int. Cl.

| | |
|---|---|
| ***B41J 29/38*** | (2006.01) |
| ***B41J 2/045*** | (2006.01) |
| ***B41J 11/00*** | (2006.01) |
| ***B41J 2/21*** | (2006.01) |

(52) U.S. Cl.

CPC ..... *B41J 2/04508* (2013.01); *B41J 2/04586* (2013.01); *B41J 2/2103* (2013.01); *B41J 2/2114* (2013.01); *B41J 11/0015* (2013.01)

(58) Field of Classification Search

CPC ..... B41J 29/38; B41J 2/2114; B41J 2/2103; B41J 11/0015; B41J 2/2117; B41J 2/04508; B41J 2/04586

USPC ..... 347/9, 12

See application file for complete search history.

(56) References Cited

U.S. PATENT DOCUMENTS

| | | | | |
|---|---|---|---|---|
| 6,412,935 | B1 | 7/2002 | Doumaux | |
| 6,435,639 | B1 | 8/2002 | Nakajima et al. | |
| 6,460,976 | B1 | 10/2002 | Oikawa | |
| 9,469,125 | B2 * | 10/2016 | Humet | B41J 2/2103 |
| 2009/0079790 | A1 | 3/2009 | Mizutani | |
| 2010/0079524 | A1 | 4/2010 | Saita et al. | |

(Continued)

FOREIGN PATENT DOCUMENTS

| | | |
|---|---|---|
| CN | 101992604 | 3/2011 |
| EP | 1016524 | 7/2000 |
| JP | 2001-239660 | 9/2001 |

(Continued)

OTHER PUBLICATIONS

International Search Report and Written Opinion for PCT/EP2012/073959 dated Jun. 26, 2013, 9 pp.

*Primary Examiner* — Jannelle M Lebron

(74) *Attorney, Agent, or Firm* — HP Inc. Patent Department

(57) ABSTRACT

Operations of printing systems are disclosed. According to examples, a deposition sequence for depositing printing fluids onto a substrate location is dynamically controlled. Sub-groups of nozzles in nozzle arrays are selected according to the deposition sequence.

18 Claims, 5 Drawing Sheets

(56) References Cited

U.S. PATENT DOCUMENTS

2011/0037800 A1 2/2011 Tanoue et al.

FOREIGN PATENT DOCUMENTS

| | | |
|---|---|---|
| JP | 2002321349 | 11/2002 |
| JP | 2009073092 | 4/2009 |
| JP | 2011-001509 | 1/2011 |
| JP | 2011037178 | 2/2011 |
| JP | 2011037222 | 2/2011 |
| JP | 2011116058 | 6/2011 |
| JP | 2011-194800 | 10/2011 |
| JP | 2012-061784 | 3/2012 |
| WO | WO-2003/043825 | 5/2003 |

* cited by examiner

FIG. 2A
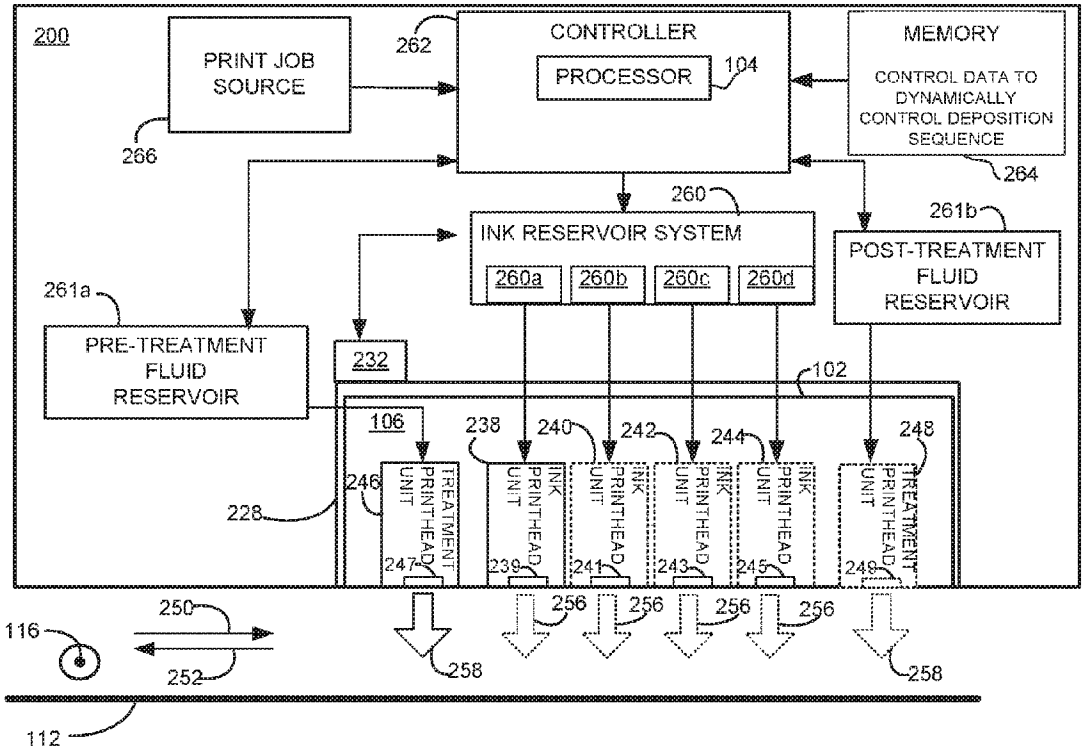
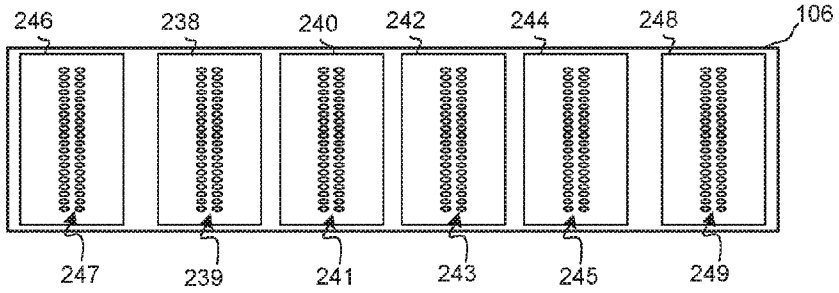
FIG. 2B

OPERATION OF PRINTING SYSTEMS

BACKGROUND

A printing system may be operated to jet a plurality of printing fluids via nozzles in a printhead. Ink and non-ink fluids are examples of printing fluids. A non-ink fluid may be a treatment fluid for treating ink on a substrate or for treating a substrate prior to receiving ink. Treatment may be, for example, to improve print quality by enhancing fixation of ink on the substrate or to protect colorant, delivered via an ink, on the substrate. A treatment fluid may be a pre-treatment fluid designed to be applied on a substrate location before ink deposition (e.g, a fixer) or a post-treatment component designed to be applied on a substrate location after ink deposition (e.g., a coating).

A pre-treatment may be applied on a portion of a substrate to enhance fixation (e.g., bonding and/or hardening) of ink on that portion of the substrate. Fixation may be performed to address coalescence, bleed, feathering, or similar effects characterized by ink migration across a printed surface. In other examples, a post-treatment may be applied to a colorant on the substrate so as to coat a printed pattern.

BRIEF DESCRIPTION OF THE DRAWINGS

In order that the present disclosure may be well understood, various examples will now be described with reference to the following drawings.

FIG. 2A is a block diagram schematically illustrating printing systems according to examples. FIG. 2B is a schematic side view of a printhead to be used with the printing system in FIG. 2A.

DETAILED DESCRIPTION

Figure 1A:
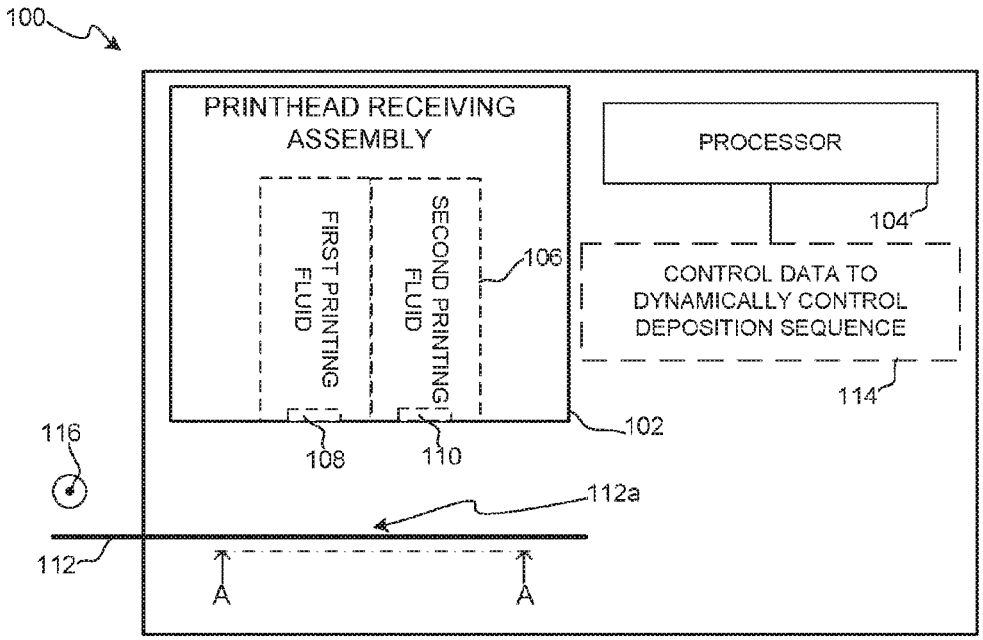
FIG. 1A is a block diagram schematically illustrating printing systems according to examples.

In the following description, numerous details are set forth to provide an understanding of the examples disclosed herein. However, it will be understood that the examples may be practiced without these details. While a limited number of examples have been disclosed, it should be understood that there are numerous modifications and variations therefrom. Like numerals may be used for like and corresponding parts of the various figures.

As set forth above, in printing, a plurality of printing fluids might be deposited onto a substrate. For example, one or more ink fluids might be deposited to deliver colorant to a substrate. A treatment fluid may be deposited on a substrate as described above.

For applying printing fluids, a printing system may be equipped with a printhead receiving assembly. The printhead receiving assembly is to receive a printhead including a first nozzle array arrangement for ejecting at least a first print fluid (e.g., ink) on a substrate location and a second nozzle array arrangement for ejecting at least a second printing fluid (e.g., treatment) on the substrate location. (It will be understood that the nozzle array arrangements eject printing fluids in multiple substrate locations for completing a printing job.). A printhead receiving assembly can be any structure to receive a printhead so that it can be functionally operated for printing a pattern on a substrate. For example, a printhead receiving assembly may include mechanical connections for positioning a printhead, electrical connections for operating nozzles in the printhead to jet print fluids, or fluid connections to provide such fluids to the printhead.

In at least some printing systems, nozzle arrays may be physically staggered. For example, ink and treatment nozzle arrays may be physically staggered to facilitate single pass printing of ink and treatment in two lines. For example, a printhead may have a pre-treatment nozzle array staggered with respect to an ink nozzle array; nozzle staggering may be such that all the pre-treatment nozzles are positioned downstream from the ink nozzles (downstream is referred to with respect to a substrate advance direction). In such a staggered printhead, a specific substrate location first encounters the pre-treatment nozzles and subsequently encounters the ink nozzles. Therefore, for each specific substrate location to be printed, ink is deposited subsequently to pre-treatment of the substrate location.

Different applications might require different deposition sequences. For example, in applications for printing textiles, a pre-treatment fluid can be laid down before or after the ink depending on a desired level of ink bleed through the textile. Pre-treatment might be applied after ink deposition to facilitate ink penetration into the textile. Pre-treatment might be fired before the ink to improve gamut in one side of the textile. In other examples, it might be advantageous to apply a post-treatment (e.g., a coating) quasi-simultaneously than the ink in order to improve printing speed. Therefore, it might be convenient to vary the deposition sequence depending on the specific application. However, the deposition sequence in physically staggered printheads cannot be dynamically controlled since the deposition sequence is determined by the staggered location of nozzle arrays. In other words, physically staggered printheads results in application of printing fluids according to a pre-defined deposition sequence.

According to at least some examples herein, a deposition sequence for depositing printing fluids onto a substrate location is dynamically controlled by selecting a sub-group of nozzles in a first nozzle array arrangement and a sub-group of nozzles in a second nozzle array arrangement. More specifically, in at least some examples herein, a physically staggered print head can be simulated using a non-staggered printhead configuration (e.g., an in-line printhead configuration) by dynamically reducing the printing swath of the ink and treatment nozzles. Thereby, a printhead can be operated without a pre-defined deposition sequence. Further, the order into which printing fluids (e.g., treatment fluids and ink fluids) are deposited onto a substrate can be dynamically controlled.

As used herein, to dynamically control a deposition sequence refers to set the sequence for depositing printing fluids on a substrate location without varying the physical configuration of the printhead. A dynamically controlled deposition sequence may be set for a specific print job so that a plurality of substrate locations to be printed receives printing fluids according to a single selected deposition sequence. In other examples, a dynamically controlled deposition sequence might be varied for different substrate locations to be printed for realizing a specific print job.

A nozzle array arrangement as used herein refers to a collection of nozzles arranged to jet a fluid (e.g., treatment or fluid) on a substrate. A nozzle arrangement is comprised of one or more nozzle arrays. A nozzle arrangement may be configured to jet one or more printing fluids via respective nozzle arrays. For example, a treatment nozzle arrangement may include a pre-treatment nozzle array to jet a pre-treatment fluid (e.g., a fixer) and a post-treatment nozzle array to jet a post-treatment fluid (e.g., a coater); an ink nozzle arrangement may include a set of ink nozzle arrays to jet different types of inks, for example one type of ink for each of the basic colors of the printer (e.g., cyan ink, magenta ink, yellow ink, or black ink).

A nozzle array refers to a grouping of nozzles configured to eject a specific printing fluid, for example a specific type of ink (e.g., cyan ink, magenta ink, yellow ink, or black ink) or a specific type of treatment (e.g., a fixer or a coater). The nozzle grouping in a nozzle array may be ordered in multiple rows and at least one column of nozzles. Other orderings of nozzle groupings can be implemented (e.g., nozzles following a zigzag pattern).

Figure 1B:
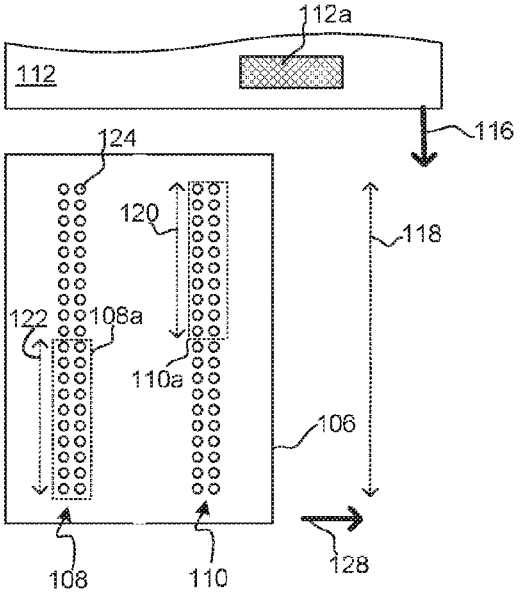
FIGS. 1B and 1C show a portion of the printing system of FIG. 1A in different operating conditions.
Figure 1C:
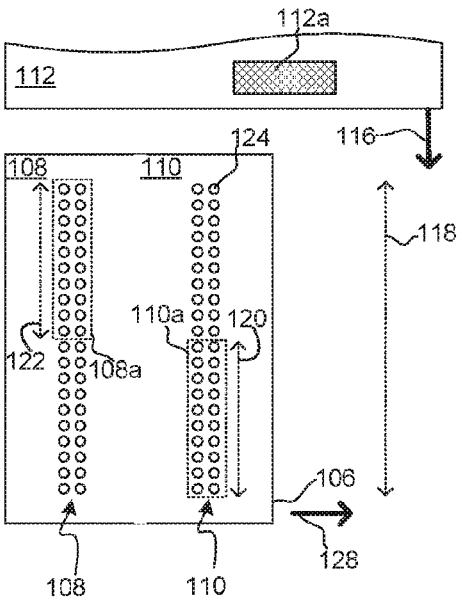

FIG. 1A is a block diagram schematically illustrating a printing system 100. FIGS. 1B and 1C illustrate a portion of printing system 100 in different operating conditions. In particular, FIGS. 1B and 1C illustrate a front view from line A-A, depicted in FIG. 1A, with different nozzle sub-groups selections. It will be understood that the following description of printing system 100 is merely illustrative and does not limit the components and functionality of printing systems according to the present disclosure.

Printing system 100 includes a printhead receiving assembly 102 and a processor 104. Printhead receiving assembly 102 is to receive a printhead 106. It will be understood that printing system 100 encompasses system configurations in which printhead 106 is not received into printhead receiving assembly 102 as well as configurations in which printheads 100 is mounted into printhead receiving assembly 102. Printhead 106 is to jet a first print fluid (e.g, an ink fluid) and a second printing fluid (e.g., a pretreatment fluid).

More specifically, as illustrated in FIGS. 1B and 1C, printhead 106 includes a first nozzle array arrangement 108 for jetting a first printing fluid on a substrate location 112*a* and a second nozzle array arrangement 110 for jetting a second printing fluid on substrate location 112*a*. Nozzle array arrangements 108, 110 may jet further printing fluids, as illustrated with respect to FIGS. 2A-2B. Printhead 106 may traverse along transition direction 128 for jetting the printing fluids into substrate location 112*a*. Nozzle array arrangements 108, 110 extend along substrate advance direction 116. Printhead 106 is illustrated in a non-staggered printhead configuration in which nozzle array arrangements 108, 110 are arranged parallel to each other and, more specifically, having an in-line printhead configuration in which nozzle rows in the different arrays are arranged in parallel.

For the sake of illustration, first nozzle array arrangement 108 and second nozzle array arrangement 110 are shown in FIGS. 1B and 1C including a single nozzle array for jetting a respective printing fluid. It will be understood that nozzle array arrangements in printhead 106 may include multiple nozzle arrays for jetting multiple printing fluids as illustrated below with respect to FIG. 2A. Nozzle arrangements 108, 110 are shown in FIGS. 1B-1C as provided in a single printhead assembly (e.g., a single assembled printhead unit including nozzle arrays for different print fluids). In other examples, printhead 106 is constituted by multiple printhead units, each being arranged for jetting ink or treatment on substrate 108 (see FIG. 2A).

Processor 104 is to dynamically control the deposition sequence for depositing the print fluids on a substrate location 112*a*. In order to dynamically control the deposition sequence, processor 104 may access control data 114. For example, control data 114 may be stored in a medium (see FIGS. 2 and 3) readable by processor 104 or provided otherwise to processor 104. The dynamic control includes operating a sub-group 108*a* of nozzles in first nozzle array arrangement 108 and a sub-group 110*a* of nozzles in second nozzle array arrangement 110. Nozzle sub-groups 108*a*, 110*a* are spatially selected to deposit print fluids onto the substrate according to a specific deposition sequence. As used herein, a spatial selection of nozzles refers to choosing the location of nozzles to be operated for jetting a printing fluid. A nozzle spatial selection may be performed by, for example, generating or modifying a printing mask according to the spatial selection, or processing a printing mask with such spatial selection.

Dynamic control of deposition sequence is illustrated in the examples of FIGS. 1B and 1C. Both Figures show two different selections of nozzle sub-groups 108*a*, 110*a* that result in different deposition sequences. In both Figures, substrate 112 is illustrated to advance along a substrate advance direction 116. Thereby, substrate 112 is to advance beneath printhead 106.

Since nozzles in printhead 106 are in-line, substrate 112 encounters nozzles from arrangements 108 and 110 at the same time. However, due to the dynamic control performed by processor 104, sequence of deposition of the printing fluids is defined by the spatial selection of nozzle sub-groups. More specifically, processor 104 selects sub-group of nozzles 108*a* and 110*a* according to control data 114. The sub-group corresponding to the fluid to be initially deposited is located downstream the sub-group corresponding to the fluid to be sub-sequentially deposited (downstream being considered with respect to the substrate advance direction). Thereby, printing fluids (e.g., corresponding to different ink types or treatments) can be deposited on substrate location 112*a* according to a specific deposition. The selection of nozzles sub-groups sets the deposition sequence of printing fluids.

The illustrated operation of printhead 106 can be seen as a simulation of a physically staggered print head using a non-staggered printhead by dynamically reducing the printing swath. In other words, printhead 106 has a physical printing swath 118 defined by the extension of nozzle arrangements 108, 110 along substrate advance direction 116. During operation of printing system 100, printhead 106 has virtual printing swaths 120, 122 defined by the extension of the selected nozzle sub-groups 108*a*, 110*b*. Thereby, it is facilitated control of the deposition sequence of jetted printing fluids on the substrate without changing the physical configuration of printhead 106.

Moreover, the example illustrated in FIGS. 1A-1C has the same physical print swath than an equivalent, physically staggered, printhead but since each nozzle array swath covers the full print zone, in principle, any sequence of print fluid deposition can be implemented by merely selecting nozzles sub-groups to be operated. For example, if it is considered that the first printing fluid is an ink and the second printing fluid is a treatment, the printing operations illustrated in FIGS. 1B and 1C can be used to vary the deposition sequence in which ink and treatment are to be deposited on substrate location 112*a* without physically modifying the spatial location of nozzles in printhead 106.

In some of the following examples, for the sake of simplicity, printing fluids are illustrated to correspond to ink fluids and treatment fluids. However, it will be understood that the present disclosure is not limited to a specific selection of printing fluid but it encompasses control of deposition sequence of any printing fluid.

In the following, reference is made to FIG. 2A for illustrating a printing system 200, which illustrates implementations of a printing system according to examples herein. FIG. 2A shows a block diagram of printing system 200. It will be understood that the following description of printing system 200 is merely illustrative and does not limit the components and functionality of printing systems according to the present disclosure.

As shown in the diagram, printing system 200 includes a carriage 228 with a printhead receiving assembly 102. In the illustrated example, printing system 200 is illustrated including printhead 106 in printhead receiving assembly 102. FIG. 2B shows a side view of printhead 106, as viewed from substrate 112 while being printed. Carriage 228 is to transition printhead 106 across the width of substrate 112, i.e., along printhead transition directions 250, 252. In the illustrated example, printhead 106 is narrower than a substrate width. Therefore, printing system 200 can perform printing across a width of substrate 112 via translation of carriage 228.

Printhead 106 in this example is illustrated to include a plurality of ink printhead units 238,240, 242, 244. Each of the ink printhead units is configured to eject ink 256 of a different color via respective ink nozzle array arrangement 239, 241, 243, 245 (shown also in FIG. 2B). Ink printheads units 238, 240, 242, 244 are fluidly connected to an ink reservoir system 260. Ink reservoir system 260 includes ink reservoirs 260*a*, 260*b*, 260*c*, 260*d* for providing ink to the respective ink printhead units. In the illustrated example, ink reservoirs 260*a*, 260*b*, 260*c*, 260*d* respectively store cyan ink, magenta ink, yellow ink, and black ink. Base colors are reproduced on substrate 112 by depositing a drop of one of the above mentioned inks onto a substrate location. Further, secondary colors can be reproduced by combining ink from different ink printhead units. In particular, secondary or shaded colors can be reproduced by depositing drops of different base colors on adjacent dot locations in the substrate location (the human eye interprets the color mixing as the secondary color or shading).

According to some examples herein, a treatment nozzle array arrangement (e.g. treatment nozzle arrangement 110) may include at least one of a first array for ejecting a pre-treatment fluid or a second array for ejecting a post-treatment fluid. In the example of FIGS. 2A and 2B, treatment printhead units 246, 248 are for treating a substrate location. Treatment printhead unit 246 is for applying a pre-treatment on the substrate location (e.g., a fixer) via a pre-treatment nozzle arrangement 247. Treatment printhead unit 246 is for applying a post-treatment on the substrate location (e.g., a coating) via a post-treatment nozzle arrangement 249.

The block diagram in FIG. 2A shows treatment printhead units 246, 248 fluidly connected to, respectively, a pre-treatment fluid reservoir 261*a* and a post-treatment fluid reservoir 261*b*. Treatment fluid reservoirs 261*a*, 261*b* are to store the treatment fluid to be jetted by treatment nozzles 247, 249. For example, pre-treatment fluid reservoir 261*a* may store a printing fluid comprised of an ink fixer component, and post-treatment fluid reservoir 261*b* may store a printing fluid comprised of a coating component. Ink reservoir system 260 and treatment fluid reservoirs 261*a*, 261*b* may include disposable cartridges (not shown). The reservoirs may be mounted on carriage 228 in a position adjacent to the respective printhead. In other configurations (also referred to as off-axis systems), the reservoirs are not mounted on carriage 228 and a small fluid supply (ink or treatment) is externally provided to the printhead units in carriage 228; main supplies for ink and fixer are then stored in the respective reservoirs. In an off-axis system, flexible conduits are used to convey the fluid from the off-axis main supplies to the corresponding printhead cartridge. Printheads and reservoirs may be combined into single units, which are commonly referred to as "pens".

In some examples herein, a treatment nozzle array arrangement may include a first nozzle array and a second nozzle array, an ink nozzle array arrangement being in-between the first array and the second array. These examples are illustrated with respect to FIGS. 2A and 2B. The treatment nozzle array arrangement of printhead 106 in FIGS. 2A and 2B includes pre-treatment nozzle array 247 and post-treatment nozzle array 249. The ink nozzle array arrangement of printhead 106 in FIGS. 2A and 2B includes ink nozzle arrays 239, 241, 243, 245. In this example, printhead 106 is physically configured with the ink nozzle arrangement in-between pre-treatment nozzle array 247 and post-treatment nozzle array 249 as considered relative to printhead transition directions 250, 252. Such nozzle arrangement configurations facilitate flexibility at the time of controlling deposition sequence, as illustrated below with respect to FIGS. 6A-6C.

It will be appreciated that examples can be realized with any number of printhead units depending on the design of the particular printing system, each printhead unit including a nozzle array for jetting a printing fluid such as ink or treatment. For example, printing system 200 may include at least one treatment printhead unit, such as two or more treatment printhead units. Furthermore, printing system 200 may include at least one ink printhead unit, such as two to six ink printhead units, or even more ink printhead units. In the illustrated examples, ink printhead units are located at one side of a treatment printhead. It will be understood that ink printheads may be located at both sides of a treatment printhead. Further, printhead units might be monolithically integrated in printhead 106. Alternatively, each printhead unit might be modularly implemented in printhead 106 so that each printhead unit can be individually replaced. Further, printhead 106 may be a disposable printer element or a fixed printer element designed to last for the whole operating life of printing system 200.

Printing system 200 further includes a controller 262, which is operatively connected to the above described elements of printing system 200. Controller 262 is shown configured to execute a print job received from a printjob source 266 according to control data stored in memory 267. Controller 262 is shown to include processor 104. Processor 104 is configured to execute methods as described herein.

Processor 104 may be implemented, for example, by one or more discrete modules (or data processing components) that are not limited to any particular hardware, firmware, or software (i.e., machine readable instructions) configuration. Processor 104 may be implemented in any computing or data processing environment, including in digital electronic circuitry, e.g., an application-specific integrated circuit, such as a digital signal processor (DSP) or in computer hardware, firmware, device driver, or software (i.e., machine readable instructions). In some implementations, the functionalities of the modules are combined into a single data processing component. In other versions, the respective functionalities of each of one or more of the modules are performed by a respective set of multiple data processing components.

Memory device 264 is accessible by controller 262. Memory device 264 stores control data in the form of process instructions (e.g., machine-readable code, such as computer software) for implementing methods executed by controller 262 and, more specifically, by processor 104. More specifically, memory 264 is to store control data to dynamically control deposition sequence as described herein. Memory device 264 may be physically constituted analogously as memory 302 described below with respect to FIG. 3.

Controller 262 receives printjob commands and data from printjob source 266, which may be a computer or any other source of printjobs, in order to print an image. In the example, controller 262 is configured to determine a print mask from the received data. The print mask may be modified according to the control data in memory 264 for dynamically control a deposition sequence. Dynamic control might also be implemented by pre-processing the print mask or generating the print mask according to a specific deposition sequence. A print mask refers to logic that includes control data determining which nozzles of the different printheads are fired at a given time to eject fluid in order to reproduce a printjob.

Controller 262 is operatively connected to treatment printhead units 246, 248, ink printhead units 238, 240, 242, 244, and the respective reservoirs to control, according to the print mask and the control data in memory 264. Thereby, controller 262, and more specifically processor 104, can control functionality of printing system 200 such as, but not limited to: a) selection of nozzle sub-groups for implementing a specific ink-treatment deposition sequence, b) operation of sub-nozzle groups for depositing printing fluids according to a deposition sequence, and c) motion of carriage 228 and substrate 112 for depositing the printing fluids according to the deposition sequence in a specific substrate location.

It will be understood that the functionality of memory 264 and print job source 266 might be combined in a single element or distributed in multiple elements. Further, memory 264 and print job source 266 may be provided as external elements of print system 200. Further, it will be understood that operation of processor 104 to dynamically control the deposition sequence is not limited to the above examples.

Figure 3:
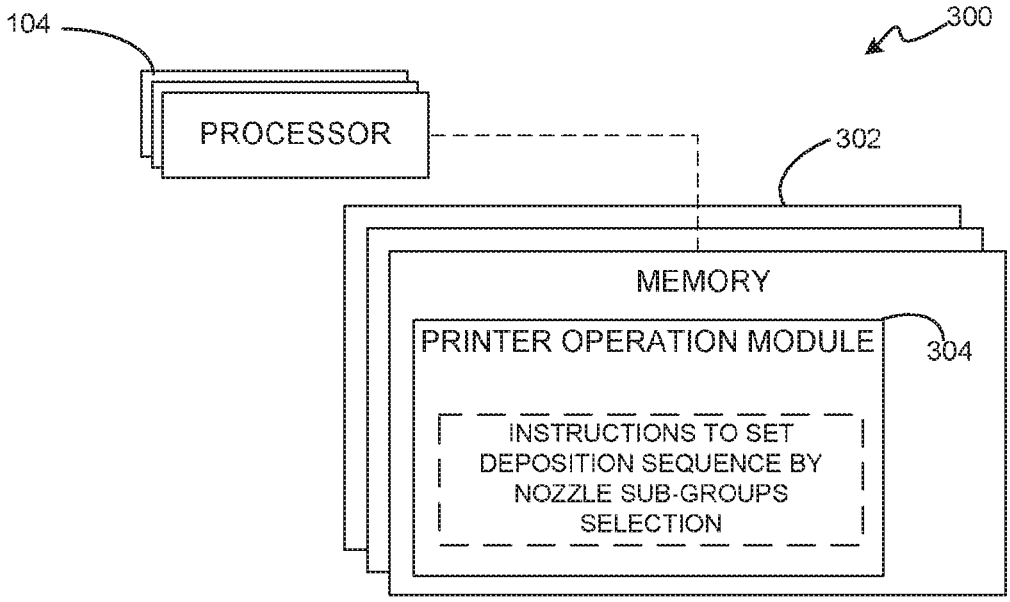
FIG. 3 is a block description of a system for causing printing systems to print images on substrates according to examples.

FIG. 3 is a block description of a system 300 for causing a printing system to print an image on a substrate according to examples. As illustrated, system 300 includes programming comprised by processor executable instructions stored on a memory media 302 in the form of a printer operation module 304. System 300 includes hardware in the form of processor 104 for executing instructions in printer operation module 304. Memory 302 may be constituted by a tangible medium readable by processor 104. Memory 302 can be said to store program instructions constituting printer operation module 304 that, when executed by processor 304, implements methods to operate printing systems as described herein. (At least some of these printing methods are illustrated below with respect to FIGS. 4 and 5.) Memory 302 may be integrated in the same device as processor 104 or it may be separate but accessible to that device and processor 104. Each of memory 302 and processor 104 may be respectively integrated in a single system component or may be distributed among multiple system components.

In an example, the program instructions constituting printer operation module 304 can be part of an installation package that can be executed by processor 104 to implement control engine 108. In this case, memory 302 may be a portable medium such as a CD, DVD, or flash drive or a memory maintained by a server from which the installation package can be downloaded and installed. In another example, the program instructions may be part of an application or applications already installed. Here, memory 302 can include integrated memory such as a hard drive. It should be noted that a tangible medium as used herein is considered not to consist of a propagating signal. In examples, the medium is a non-transitory medium.

Figure 4:
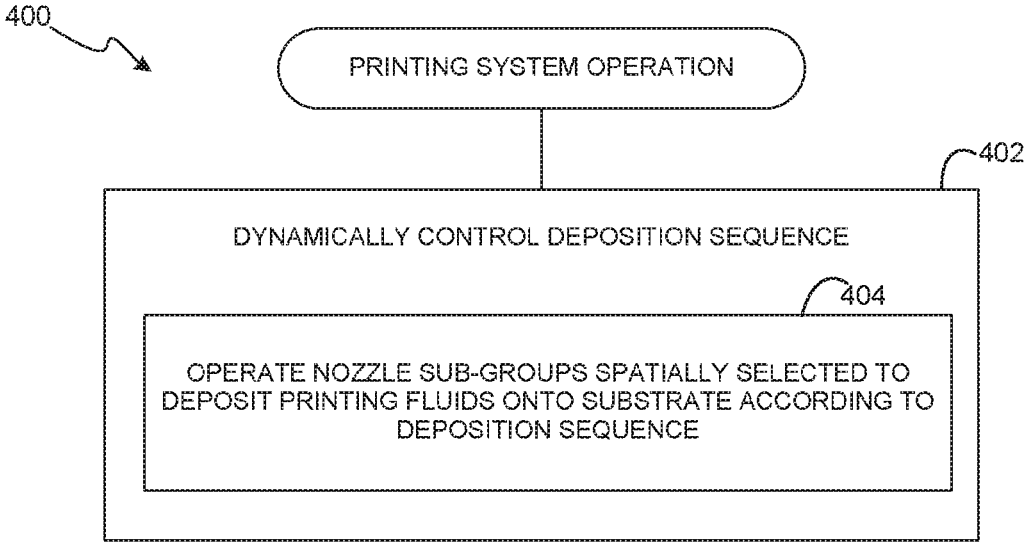
FIG. 4 is a flow chart that implements examples of methods for printing an image on a substrate.
Figure 5:
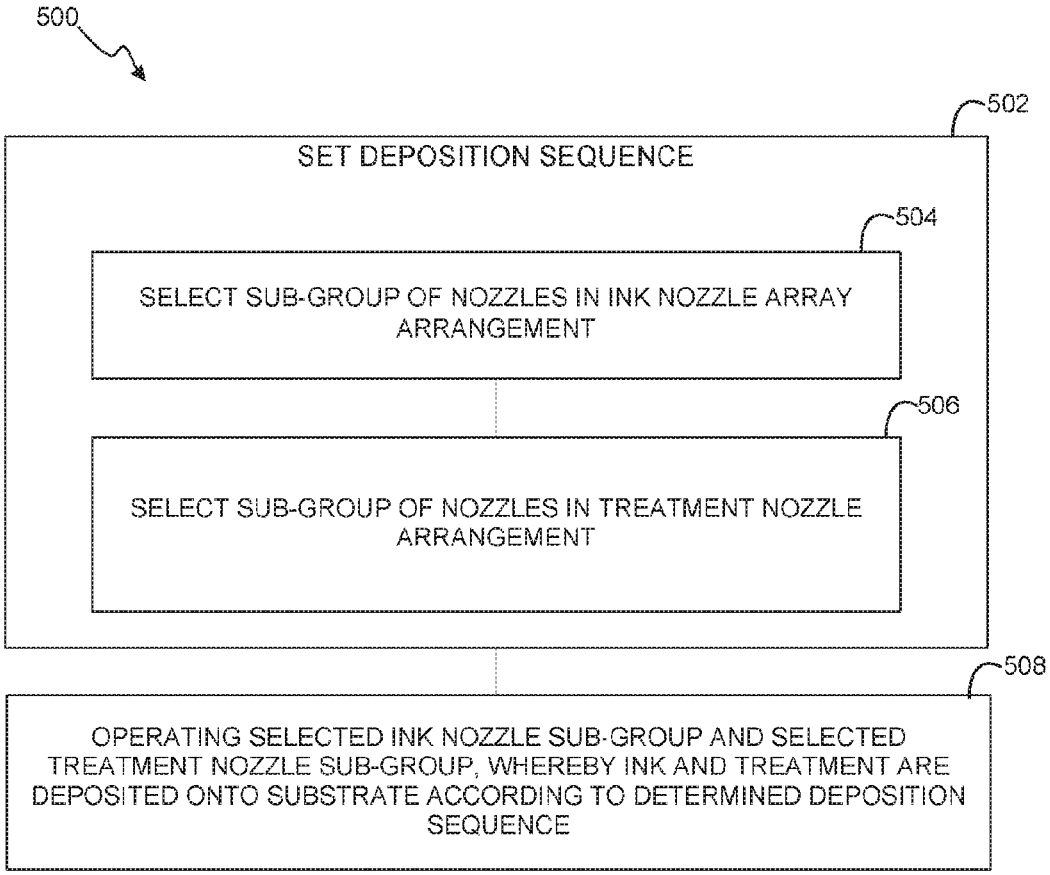
FIG. 5 is a flow chart that implements examples of methods for printing an image on a substrate.

FIGS. 4 and 5 show flow charts that implements examples of methods for printing an image on a substrate. These methods may be implemented using systems such as the printing systems illustrated above with respect to FIGS. 1 and 2. In other examples, a system as illustrated in FIG. 3 can be used to implement these methods. In discussing FIGS. 4 and 5 reference is made to the diagrams of FIGS. 6A to 6C to provide contextual examples. It will be understood that implementation, however, is not limited to those examples.

FIG. 4 shows a flow chart 400 that implements examples of methods for printing an image on a substrate. Flow chart 400 includes, at block 402, to dynamically control a deposition sequence for depositing printing fluids (e.g., for treatment and ink) on a substrate location. Processor 107 may be responsible of implementing block 402 by accessing control data 114 (see FIG. 1A).

Block 402 includes a sub-block 404 in which a sub-group of nozzles in the nozzle array arrangements are operated to deposit printing fluids onto the substrate according to the deposition sequence. The nozzles sub-groups are spatially selected to deposit the printing fluids onto the substrate according to the deposition sequence. More specifically, a nozzle sub-group corresponding to the fluid to be initially deposited can be selected to be spatially located downstream the sub-group corresponding to the fluid to be sub-sequentially deposited (downstream is with respect to the substrate advance direction).

To implement sub-block 404, processor 104 may determine the deposition sequence. For example, it may receive a print mask in which it is specified the sequence into which ink and treatment is to be deposited on a substrate location. Processor 104 may then set the deposition sequence by selecting the nozzles sub-groups. Finally, processor 104 may cause generation of electrical signals into the actuation elements of the nozzles sub-groups to jet the print fluids according to the deposition sequence. Alternatively, processor 104 may receive instructions that indicate which deposition is to be determined. Processor 104 may then follow these instructions to generate or modify the printing mask according to the deposition sequence.

Execution of flow chart 400 is further illustrated in the following by referring back to FIGS. 1B and 1C. Looking at FIG. 1B, printing system 100 can be used to implement a deposition sequence corresponding to firstly deposit treatment and subsequently deposit ink on substrate location 112*a*. Accordingly, processor 104 may select nozzle sub-group 110*a*, corresponding to treatment, to be located downstream of nozzle sub-group 108*a*, corresponding to ink, so that ink is deposited on treated substrate location 112. Looking at FIG. 1C, printing system 100 can be used to implement a deposition sequence corresponding to firstly deposit ink and subsequently deposit treatment on substrate location 112*a*. Accordingly, processor 104 may selects nozzle sub-group 108*a*, corresponding to ink, to be located downstream of nozzle sub-group 110*a*, corresponding to treatment, so that treatment is deposited on inked substrate location 112. Further examples of dynamic control of different deposition sequences are illustrated with respect to FIGS. 6A to 6C.

Methods for printing an image on a substrate according to examples herein may include setting a deposition sequence. Setting a deposition sequence as used herein refers to configure operation of a printing system, so that printing fluid (e.g., for treatment and ink) are deposited according to a specific deposition sequence. FIG. 5 is a flow chart 500 that implements examples of methods for printing an image on a substrate, which in particular illustrate setting of a deposition sequence. In some of the following examples, for the sake of simplicity, printing fluids are illustrated to correspond to ink fluids and treatment fluids. However, it will be understood that the present disclosure is not limited to a specific selection of printing fluid but it encompasses control of deposition sequence of any printing fluid.

At block 502, a deposition sequence for depositing ink and treatment onto a substrate location is set. The deposition sequence can be set by selecting (i) a sub-group of nozzles in the ink nozzle array arrangement at sub-block 504, and (ii) selecting a sub-group of nozzles in the treatment nozzle array arrangement at sub-block 506. Thereby, the selection of nozzles sub-groups in the respective arrangements fixes the sequence into which treatment and ink are to be deposited on the substrate location. At block 508, the selected nozzle sub-groups are operated, whereby ink and treatment are deposited on the substrate location according to the deposition sequence.

Figure 6A:
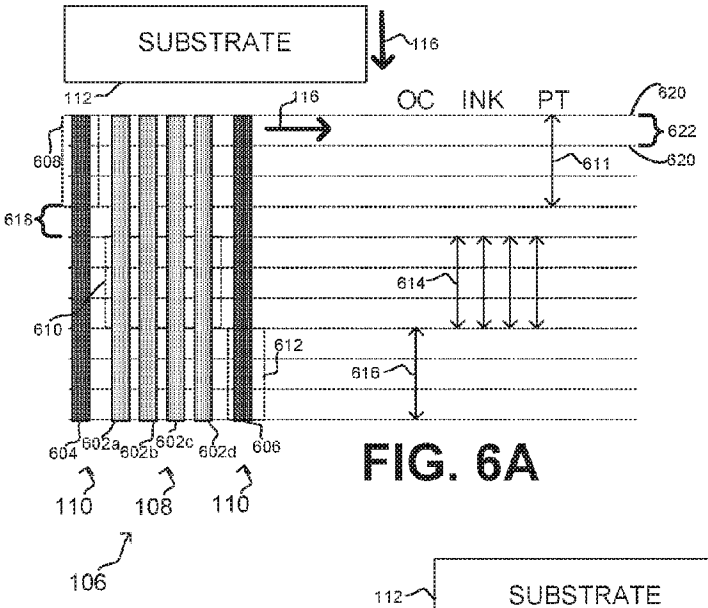
FIGS. 6A-6C are schematic diagrams illustrating operations of printing systems according to examples herein.
Figure 6B:
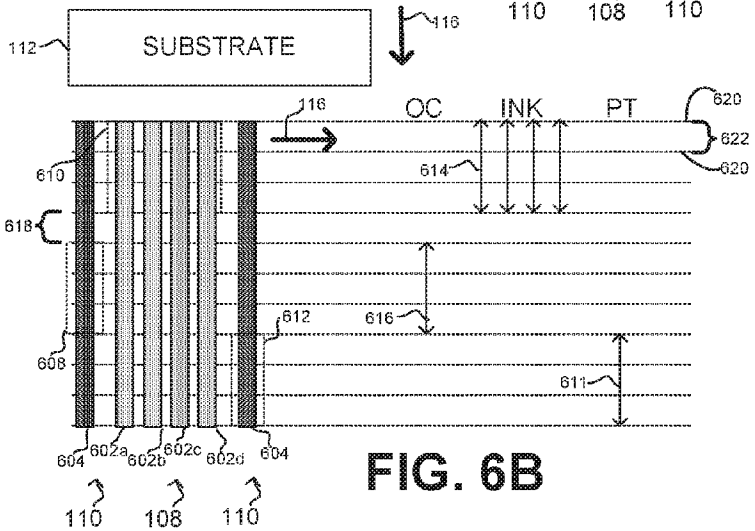
Figure 6C:
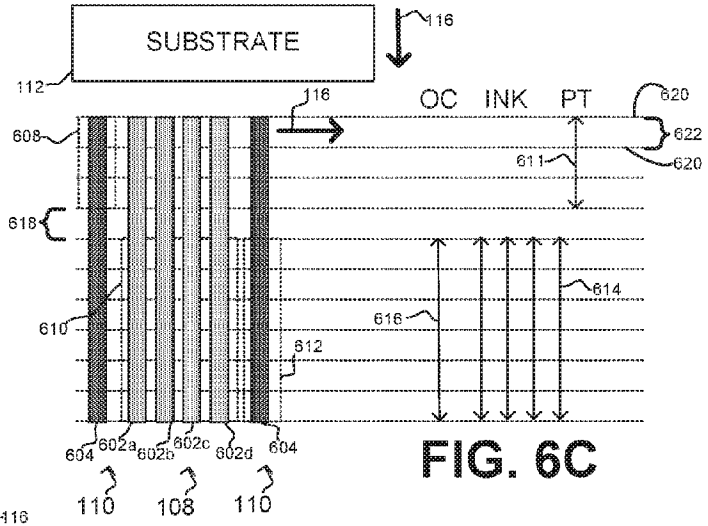

FIGS. 6A-6C schematically show operation of a printing system (e.g., printing system 200 in FIG. 2A) for depositing printing fluids according to different deposition sequences. In the illustrated examples, the printing fluids correspond to ink and treatment, which includes a pre-treatment PT and a post-treatment OC. Printhead 106 is shown to include ink nozzle array arrangement 108 and treatment nozzle array arrangement 110. In the example, ink nozzle array arrangement 108 includes four ink nozzle arrays 602*a*-602*d* for jetting, respectively, four different types of ink fluids (e.g., respectively corresponding to cyan, magenta, yellow, and black). Treatment nozzle arrangement 110 is shown to include a pre-treatment nozzle array 604 (e.g., corresponding to a fixer) and a post-treatment nozzle array 606 (e.g., corresponding to a coater).

For each of the operational modes in FIGS. 6A-6C, a sub-group of nozzles for each of the nozzle arrays is selected: a pre-treatment nozzle sub-group 608 is selected for pre-treatment nozzle array 604, an ink nozzle sub-group 610 is selected collectively for ink nozzle arrays 602*a*-602*d*, and a post-treatment nozzle sub-group 612 is selected for post-treatment nozzle array 606. In the illustrated example, the same ink nozzle sub-group 610 is selected in each of ink nozzle arrays 602*a*-602*d*. It will be understood that different ink nozzle sub-groups can be selected in ink nozzle arrays 602*a*-602*d* in order to modify deposition sequence of ink fluids.

A selection of a nozzle sub-group results in a definition of a corresponding print swath. For example, pre-treatment nozzle sub-group 608 defines a pre-treatment print swath 611, ink nozzle sub-group 610 defines an ink print swath 614, post-treatment nozzle sub-group 612 defines a post-treatment print swath 616. In the illustrated example, print swaths correspond to a multiple of a substrate advance length 622 (substrate advance is illustrated by parallel lines 620) in order to facilitate a convenient coverage of a substrate location with printing fluids. In the illustrated example, nozzle sub-groups 608, 610, 612 define print swaths corresponding to three times substrate advance length 622. Print swaths might correspond to any substrate advance multiple such as, but not limited to, one, two, four, or ten.

FIG. 6A shows a printing operation in which printing fluids are to be deposited on a substrate location according to the following deposition sequence: first a pre-treatment fluid (e.g. a fixer), second ink fluids, and third a post-treatment fluid (e.g., a coating). Therefore, in this example, pre-treatment nozzle sub-group 608 is selected to be spatially located downstream of ink nozzle sub-group 610, and ink nozzle sub-group 610 is selected to be downstream of post-treatment nozzle sub-group 612 (downstream with respect to substrate advance direction 116). Thereby, a deposition sequence is set in which (i) a substrate location firstly receives pre-treatment for treating that substrate location before it receives ink, (ii) the treated substrate location receives ink thereon, and (iii) post-treatment (e.g., a coating) is applied on the inked location.

In certain applications, the level of ink penetration when ink is deposited on a pre-treated substrate location might be relatively low. For such applications, it might be advantageous to allow a certain level of ink penetration into the substrate. However, if ink is deposited on a treated substrate as in the example of FIG. 6A, a desired level of ink penetration might not be achieved. Accordingly, in some examples herein, nozzle subgroups are selected to set a deposition sequence in which ink is deposited on a substrate location before deposition of a pre-treatment (e.g., a fixer). Such examples are illustrated with respect to FIG. 6B.

FIG. 6B shows a printing operation in which printing fluids are to be deposited on a substrate location according to the following deposition sequence: first ink fluids, second a pre-treatment fluid (e.g. a fixer), and third a post-treatment fluid (e.g., a coating). Therefore, in this example, ink nozzle sub-group 610 is selected to be spatially located downstream of pre-treatment nozzle sub-group 608, and pre-treatment nozzle sub-group 608 is selected to be downstream of post-treatment nozzle sub-group 612 (downstream with respect to substrate advance direction 116). Thereby, a deposition sequence is set in which, (i) the substrate location firstly receives ink, (ii) ink is allowed to penetrate into the substrate a during a certain time interval (this time interval is proportional to a gap 618 between ink nozzle sub-group 610 and pre-treatment nozzle sub-group 608, as further detailed below), and (iii), subsequently, a post-treatment is applied on deposited ink for, for example, coating of an ink pattern on the substrate.

In some examples herein, the deposition sequence is to quasi-simultaneously deposit printing fluids on a substrate location. In such a quasi-simultaneously deposition sequence, the print swath can be enlarged in comparison to a simulated staggering as illustrated above and, therefore, printer speed might be improved. A specific example of such an operation is illustrated with respect to FIG. 6C. Therein, ink and post-treatment are to be to be quasi-simultaneously deposited on a substrate location. To set such a deposition sequence, ink nozzle sub-group 610 and post-treatment nozzle sub-group 612 are selected parallel to each other with equivalent dimensions so that ink and pre-treatment are deposited on a substrate location during the same transition of printhead 106. It will be understood that there is a certain delay between deposition of ink and post-treatment onto a specific substrate location. (This delay is due to the time required for positioning the respective nozzle arrays beneath the substrate location during printhead transition across the substrate width.)

As mentioned above, a time interval between depositions of different printing fluids on a substrate location can be defined by selection of a gap between the nozzles sub-groups with respect to substrate advance direction 116. More specifically, nozzle sub-groups may be selected such that there is a gap 618 between the nozzle sub-groups. The gap between nozzle sub-groups can be set to a multiple of a substrate advance. In FIG. 6A to 6C. (A printing system may be operated to advance substrate 112 a substrate advance length 622 before selected nozzles are fired). Gap 618 defines a time interval between depositions of printing fluids from selected nozzle sub-groups.

In the examples of FIGS. 6A and 6C, gap 618 is defined between pre-treatment nozzle sub-group 608 and ink nozzle sub-group 610. In this example, gap 618 results in a time delay between laying down pre-treatment and ink deposition. Such a time modulation between pre-treatment and ink may be used to improve efficiency of the pretreatment on some substrate types in which the pre-treatment requires a certain time before ink deposition for achieving a desired effect. In the example of FIG. 6B, gap 618 is defined between ink nozzle sub-group 610 and pre-treatment nozzle sub-group 608. In this example, gap 618 results in a time delay between laying down ink and pre-treatment deposition. Such a time modulation between pre-treatment and ink may be used to improve absorption of ink by the substrate before treating the ink on the substrate.

In the foregoing description, numerous details are set forth to provide an understanding of the examples disclosed herein. However, it will be understood that the examples may be practiced without these details. While a limited number of examples have been disclosed, numerous modifications and variations therefrom are contemplated. It is intended that the appended claims cover such modifications and variations. Further, flow charts herein illustrate specific block orders; however, it will be understood that the order of execution may differ from that which is depicted. For example, the order of execution of two or more blocks may be scrambled relative to the order shown. Also, two or more blocks shown in succession may be executed concurrently or with partial concurrence. Further, claims reciting "a" or "an" with respect to a particular element contemplate incorporation of one or more such elements, neither requiring nor excluding two or more such elements. Further, the terms "include" and "comprise" are used as open-ended transitions.

What is claimed is:

1. A printing system, comprising:

a printhead receiving assembly to receive a printhead including a first nozzle array arrangement for jetting a first printing fluid, a second nozzle array arrangement for jetting a second printing fluid, and a third nozzle array arrangement for jetting a third printing fluid; and a processor to operate the first nozzle array arrangement, the second nozzle array arrangement, and the third nozzle array arrangement to deposit the first and the second printing fluids onto a swath of a substrate within a same pass of the printhead over the swath, and deposit the third printing fluid onto the swath within a different pass of the printhead over the swath after the substrate has advanced in relation to the printhead in a substrate advance direction perpendicular to a pass direction of the printhead.

2. The printing system of claim 1, wherein the first and the second printing fluids are deposited quasi-simultaneously, and the third printing fluid is deposited non-quasi-simultaneously.

3. The printing system of claim 1, wherein the first nozzle array arrangement and the second nozzle array arrangement are arranged parallel to each other with nozzles disposed in a non-staggered configuration.

4. The printing system of claim 1, wherein the first printing fluid is an ink fluid and the second printing fluid is a treatment fluid.

5. The printing system of claim 4, wherein the second nozzle array arrangement is for jetting a treatment fluid and includes at least one of a first array for ejecting a pre-treatment fluid or a second array for ejecting a post-treatment fluid.

6. The printing system of claim 5, wherein the second nozzle array arrangement includes the first array and the second arrays, the first nozzle array arrangement being in-between the first array and the second arrays with respect to the substrate advance direction.

7. The printing system of claim 1, wherein the printing system includes the printhead.

8. A non-transitory computer-readable medium storing code executable by a processor to:

operate a first nozzle arrangement of a printhead jetting a first printing fluid and a second nozzle arrangement of the printhead jetting a second printing fluid to deposit the first and the second printing fluids onto a swath of a substrate within a same pass of the printhead over the swath; and operate a third nozzle arrangement of the printhead jetting a third printing fluid to deposit the third printing fluid onto the swath within a different pass over the swath after the substrate has advanced in relation to the printhead in a substrate advance direction perpendicular to a pass direction of the printhead.

9. The non-transitory computer-readable medium of claim 8, wherein the first and the second printing fluids are deposited quasi-simultaneously, and the third printing fluid is deposited non-quasi-simultaneously.

10. The non-transitory computer-readable medium of claim 8, wherein the code is executable by the processor to further:

advance the substrate in relation to the printhead a substrate advance length along the substrate advance direction, wherein the swath corresponds to a multiple of the substrate advance length.

11. The non-transitory computer-readable medium of claim 8, wherein the code is executable by the processor to further:

define a time interval between deposition of the first and second printing fluids on the swath via a gap set between the first and second nozzle arrangements, the gap being in the substrate advance direction.

12. The non-transitory computer-readable medium of claim 8, wherein the first treatment nozzle array arrangement includes a nozzle array for ejecting a pre-treatment fluid, and the pre-treatment fluid is deposited on a substrate location before ink is deposited on the substrate location.

13. The non-transitory computer-readable medium of claim 8, wherein the first treatment nozzle array arrangement includes a nozzle array for ejecting a post-treatment fluid; and the post-treatment fluid and ink are deposited quasi-simultaneously on a substrate location.

14. A method comprising:

operating a printhead for depositing ink and treatment on a substrate location according to a deposition sequence, the printhead including a first nozzle array arrangement for ejecting a first fluid onto a substrate location, and a second nozzle array arrangement for ejecting a second fluid onto the substrate location, comprising:

determining a deposition sequence for depositing the first and second fluids on the substrate location; and operating a sub-group of nozzles in the first nozzle array arrangement and a sub-group of nozzles in the second treatment nozzle array arrangement according to the deposition sequence, wherein the first and second fluids are quasi-simultaneously deposited onto a swath of the substrate within a same pass of the printhead over the swath.

15. The print method of claim 14, wherein deposition sequence is further for depositing a third fluid ejected by a third nozzle array arrangement of the printing arrangement on the substrate location, and wherein operating the printhead further comprises:

operating a sub-group of nozzles in the third nozzle array arrangement according to the deposition sequence, wherein the third fluid is non-quasi-simultaneously deposited onto the swath of the substrate within a different pass of the printhead over the swath.

16. The print method of claim 14, wherein the sub-groups define print swaths corresponding to a multiple of a substrate advance length.

17. The print method of claim 14, wherein the sub-groups define a gap between the sub-groups along the substrate advance direction, the gap width being chosen to define a time interval between deposition of the first and second fluids on the substrate location.

18. The print method of claim 14, wherein depositing the second fluid comprises at least one of:

ejecting fixer to facilitate fixing of the first fluid onto the substrate via a nozzle array of the second nozzle array arrangement, or ejecting a post-treatment fluid to so as to form a coating on the first fluid deposited onto the substrate via a nozzle array of the second nozzle array arrangement.

* * * * *